US006185794B1

(12) United States Patent
Maggi

(10) Patent No.: US 6,185,794 B1
(45) Date of Patent: Feb. 13, 2001

(54) BUCKLE, PARTICULARLY FOR THE HEEL STRAP OF OPEN HEEL SWIM FINS

(75) Inventor: Renzo Maggi, Riva Nazzano (IT)

(73) Assignee: Salvas Sub S.p.A., Castelnuovo Scrivia (AL) (IT)

( * ) Notice: Under 35 U.S.C. 154(b), the term of this patent shall be extended for 0 days.

(21) Appl. No.: 09/097,146

(22) Filed: Jun. 12, 1998

(30) Foreign Application Priority Data

Jun. 13, 1997 (IT) ..... SV97A0031

(51) Int. Cl.[7] ..... A44B 11/25
(52) U.S. Cl. ..... 24/170; 24/625; 24/191
(58) Field of Search ..... 24/265 R, 265 BC, 24/625, 68 R, 68 SK, 701, 666, 170, 191, 193; 441/64

(56) References Cited

U.S. PATENT DOCUMENTS 4,795,384 * 1/1989 Hattori .
4,795,385 1/1989 Matsuoka .
5,545,067 8/1996 Garofalo .
5,561,891 * 10/1996 Hsieh .
5,607,334 3/1997 Garofalo .
5,749,127 * 5/1998 Hsieh .
5,893,199 * 4/1999 Anscher .

* cited by examiner

*Primary Examiner*—James R. Brittain
(74) *Attorney, Agent, or Firm*—James Creighton Wray; Meera P. Narasimhan

(57) ABSTRACT

The buckle (F) consists of a base part (F1), attached to one side of the footpocket of the fin (P) and comprising a movable strap-locking tooth (22), counteracting elastic means (24), associated to said tooth (22) and manual strap-releasing means (17) connected to said tooth, and of a strap-fastening part (F2), which only comprises strap-guiding means (13) for returning the strap (C), and is joined to the base part (F1), in such a way as to be able to slide in the longitudinal direction of the strap (C) between a retracted strap-tightening position, wherein it is automatically hooked to the base part (F1), so as to be manually releasable, and the strap-locking tooth (22) is engaged with the teeth (C1) of the strap (C), and a forward quick strap-loosening position, wherein the strap-locking tooth (22) is disengaged from the teeth (C1) of the strap and allows the latter to slide freely in both senses.

18 Claims, 6 Drawing Sheets

BUCKLE, PARTICULARLY FOR THE HEEL STRAP OF OPEN HEEL SWIM FINS

BACKGROUND OF THE INVENTION

The invention relates to a buckle for a strap designed for fastening an object, particularly for the heel strap of swim fins of the open heel type. This strap is provided with a sequence of transverse teeth on one of its sides and is adjustably connected, at least at one of its ends, to the object to be fastened, particularly to said fin, at one side of the footpocket, by means of the buckle, which comprises a strap-guiding member, extending on the non-toothed side of the strap, transverse thereto, and around which said strap end is folded and returned, and a movable strap-locking tooth, extending, transverse to the strap, on the toothed side thereof, in coincidence with the strap-guiding member, and cooperating, together with counteracting elastic means, with the strap teeth, in such a way that the strap is only allowed to slide freely, when subject to a manual pulling force exerted on the free returned end of the strap, towards tightening the strap, whereas the strap is prevented from sliding in the opposite sense, i.e. towards loosening it. The buckle also comprises hand-operated strap-releasing means, for moving the strap-locking tooth away from the strap-guiding member, against the action of the associated counteracting elastic means, to such an extent as to disengage the strap-locking tooth from the strap teeth and to allow the strap to slide freely in both senses as long as the manual action is exerted on the strap-releasing means.

Buckles of this type are known, in which all operating members, i.e. the strap-guiding member, the movable strap-locking tooth with the counteracting elastic means associated thereto and the manual strap-releasing means are provided on a single body, attached to the body to be fastened, and particularly on one side of the footpocket of the open heel swim fin. This known construction of the buckle has the drawback that, in order to let the strap slide with respect to the buckle towards quick loosening and for a longer segment, for example in order to unfasten quickly the fastened object, and particularly to unfasten the swim fin from its respective foot, the strap-releasing means have to be continuously manually operated all the while, for example by exerting pressure on a lever bearing the strap-locking tooth and being stressed by the associated counteracting elastic means. This prolonged manual action is inconvenient and at times even impossible, and engages a hand of the user, keeping it busy for a relatively long time, for example to contribute to the strap loosening and unfastenening operations.

U.S. Pat. No. 4.795.385 discloses a buckle of the type described hereinbefore, whereby the heel strap of a swim fin of the open heel type is attached to the fin at least at one end of the footpocket. This known buckle consists of a fixed part, connected to the fin, and of a detachable part, which bears all the operating members, i.e. the strap-guiding member, the strap-locking tooth, with the associated counteracting elastic means, and the manual strap-releasing means. The detachable part is connected to the fixed part by elastic snap coupling means, which may be uncoupled with a relatively simple and quick uncoupling operation, so as to cause the detachable part of the buckle, together with the corresponding end of the heel strap, to be completely separated from the fixed part of the buckle, and therefore from the fin. This known construction of the buckle, allowing to unfasten the fin quickly from the foot of the swimmer, has other drawbacks, including that of causing an end of the heel strap to be completely detached from its respective fin, so that the heel strap is anyway opened.

European patent application 0 687 484 discloses a buckle of the type described hereinbefore, designed to connect at least one end of the heel strap of an open heel swim fin, to the corresponding side of the footpocket. This buckle also consists of a fixed part, linked to the fin, and of a movable part which bears all the operating members, i.e. the strap-guiding member, the movable strap-locking tooth, with the counteracting elastic means associated thereto, and the manual strap-releasing means. These two parts of the buckle are connected by means of a strap-stretching lever interposed therebetween, which has its fulcrum on the fixed part and is articulated to the movable part. The strap-stretching lever may be manually overturned about 180°0 about its fulcrum between an angular strap-stretching position, wherein its articulation to the movable part of the buckle is between the point in which the fixed part of the buckle is attached to the fin and the fulcrum of the strap-stretching lever on said fixed part, and an angular strap-loosening position, in which the articulation of the strap-stretching lever to the movable part of the buckle is on the opposite side with respect to the fulcrum of the strap-stretching lever. Although this known construction of the buckle allows the heel strap to be quickly loosened and, at the same time, the fin to be unfastened from the foot of the swimmer by simply manually overturning the strap-stretching lever, without detaching or opening the heel strap, it has the drawbacks of comprising a third additional part, consisting of a strap-stretching lever, and of requiring, for quick strap stretching and loosening operations, a certain clearance on the side of the foot, which is needed to overturn the strap-stretching lever, but not always available in practice. Moreover, the overturnable strap-stretching lever may be easily accidentally and unintentionally shifted to its strap-loosening position.

SUMMARY OF THE INVENTION

The invention has the object to remove said drawbacks of well-known buckles and to provide a buckle of the type described hereinbefore, allowing to obtain, by a simple and little space requiring construction, quick loosening and stretching of the strap, with easy and short manual operations, without separating the buckle into two parts, i.e. without having to detach the corresponding strap end from the object to be fastened, and hence without opening the strap, and also without requiring, outside the buckle, a much larger operating space than the respective thickness of the buckle.

This problem is solved by the invention, thanks to a buckle of the type described hereinbefore, characterized in that it consists of a base part, attached to the object to be fastened, and particularly to one side of the footpocket of a swim fin and comprising the movable strap-locking tooth, its respective counteracting elastic means and manual strap-releasing means, and of a strap-fastening part, which only comprises strap-guiding means for returning the strap, and is joined to the base part, in such a way as to be able to slide in the longitudinal direction of the strap between a retracted strap-tightening position, wherein it is automatically hooked to the base part of the buckle, in a manually releasable way, and the strap-guiding member is so close to the strap-locking tooth, that said tooth is operatively engaged with the teeth of the strap (C) and only allows the strap to slide freely towards tightening it, and a forward strap-sliding position, wherein the strap-guiding member is moved away from the strap-locking tooth, to such an extent, that said tooth is disengaged from the teeth of the strap and allows the strap to slide freely in both senses.

According to another characteristic of the invention, between the base part and the slidable strap-fastening part of the buckle, there are provided cooperating end-of-stroke abutments, which are engaged with each other in the forward strap-sliding position of the strap-fastening part of the buckle, and prevent said strap-fastening part from being further extracted and detached from the base part of the buckle.

When the slidable strap-fastening part of the buckle according to the invention is in its retracted strap-tightening position, wherein it is hooked to the base part, then the strap may be fastened in the usual way, by exerting a manual pulling action on its free end, returned around the strap-guiding member. In this retracted position of the slidable strap-fastening part of the buckle according to the invention, the strap tension may also be adjusted towards loosening the strap, by operating manually the strap-releasing means in the usual way and thus disengaging the strap-locking tooth from the strap, only for the time required by the manual operation of said strap-releasing means. In order to get the strap quickly and completely loosened, the slidable strap-fastening part of the buckle is released from the base part and moved with respect to it up to the forward strap-sliding position, wherein it is stopped by the end-of-stroke abutments, and wherein the strap-locking tooth leaves the strap completely free, so that the latter may be allowed to slide towards loosening to the desired extent, and with no need to exert, at the same time, other manual unlocking operations. When the desired strap loosening level is reached, the slidable strap-fastening part of the buckle may be brought back to its retracted strap-tightening position, wherein it is hooked again to the base part of the buckle and wherein the loosened strap is kept linked to the buckle and locked against further loosening sliding movements. Alternatively, in the forward strap-sliding position of the slidable strap-fastening part of the buckle, the strap may be also completely slipped off from the strap-fastening part and detached from the buckle.

The buckle according to the invention may be provided in several construction alternatives. One preferred embodiment, wherefrom further characteristics and advantages of the invention will be also apparent, will be described hereafter by way of example, with reference to the attached drawings, in which:

Figure 1:
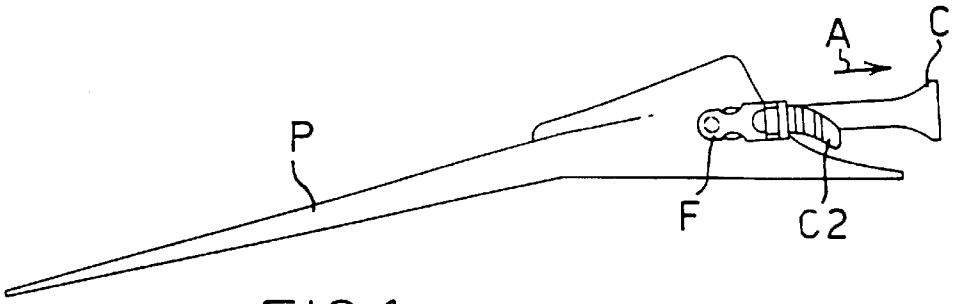
FIG. 1 is a lateral elevational view of a swim fin, whose heel strap is connected to the fin by means of a buckle according to the invention.

Referring to the figures, the illustrated embodiment relates to a swim fin P, of the open heel type, and the buckle F according to the invention is used to adjustably connect the heel strap C of this fin P to one side of the footpocket of the fin P. However, the buckle according to the invention is not intended to be limited to this particular preferred application to swim fins of the said type, but may be applied in the same manner and with the same advantages in any other field and to any other strap, fastening and attaching two parts or ends of any object, even to buckles connecting the two ends of the same strap.

The buckle according to the invention consists of a base part F1 and of a strap-fastening part F2. The base part F1 is attached to the fin P, whereas the strap-fastening part F2 is joined to the base part F1 so as to be able to slide in the longitudinal direction of the strap C.

Particularly, in the illustrated embodiment, the base part F1 of the buckle has a box-like shape, open towards the strap-fastening part F2 and comprises a bottom 1, a cover 2, and side walls 3. The bottom 1 is provided with a hole 4 having, on the side facing the strap-fastening part F2, a part 104 with a greater diameter and, on the opposite side, a part 102 with a smaller diameter. Thanks to this hole 4, the base part F1 of the buckle has an angularly oriented link to a pin 105, 205, formed of one piece with the fin P, and laterally projecting therefrom. This pin is shown by dashed and slotted lines in FIGS. 2 and 3 and comprises a widened head 105, which is inserted in the base part F1 of the buckle through the part 104 with the greater diameter, of its bottom hole 4, and a neck 205 with a smaller diameter, which is housed in the part 204 with the smaller diameter of said bottom hole 4 of the base part F1 of the buckle, by a subsequent corresponding movement of this base part F1 towards the associated strap-fastening part F2 (towards the right in FIGS. 2 and 3).

Naturally, the attachment and the angularly oriented link of the base part F1 of the buckle to the body of the fin P may be made in any other way and, to this purpose, the base part F1 of the buckle may be provided with any construction means.

On the side facing the base part F1, the strap-fastening part F2 of the buckle has a plate-like member 6, parallel to the bottom 1 of the base part F1, which may be introduced in this base part F1 through the open side thereof, facing the strap-fastening part F2. The plate-like member 6 of the strap-fastening part F2 has a median longitudinal extension 106, tapering on the side facing the lower base part F1. On their lower side, the plate-like member 6 and its tapered median extension 106 are provided with two parallel and spaced longitudinal guide ribs 7, a corresponding longitudinal guide rib 8, provided on the bottom 1 of the base part F1 being slidably engaged therebetween. The tapered extension 106 of the plate-like member of the strap-fastening part F2 is provided, on its upper side, with two parallel and spaced longitudinal guide wings 9, which are slidably engaged between two corresponding spaced and parallel longitudinal guide ribs 10, provided on the inner side of the cover 2 of the box-like base part F1 of the buckle. By this arrangement, the strap-fastening part F2 of the buckle is slidably guided in the base part F1 of the buckle, in a safe manner, with no risk of getting stuck.

The outward end of the plate-like member 6 of the slidable strap-fastening part F2, i.e. the end facing the strap C, is made of one piece with two spaced and parallel longitudinal side walls 11, projecting out of the plate-like member 6, and connected to each other by a cross member 12. Between these side walls 11, a strap-guiding roller 13, extending transverse to the strap C is rotatably mounted. Particularly, in the illustrated embodiment, the strap-guiding roll 13 is supported by its end journals 113 so as to rotate in corresponding holes 14, formed in the side walls 11 of the strap-fastening part F2 of the buckle. The end journals 113 of the strap-guiding roller 13 are inserted in their respective holes 14 of the side walls 11 by elastically opening these side walls 11 apart, and with the help of guide grooves 15, which are formed in the inner faces of the side walls 11, and extend from their free edge (the upper edge in FIG. 4) up to their respective holes 14.

Figure 2:
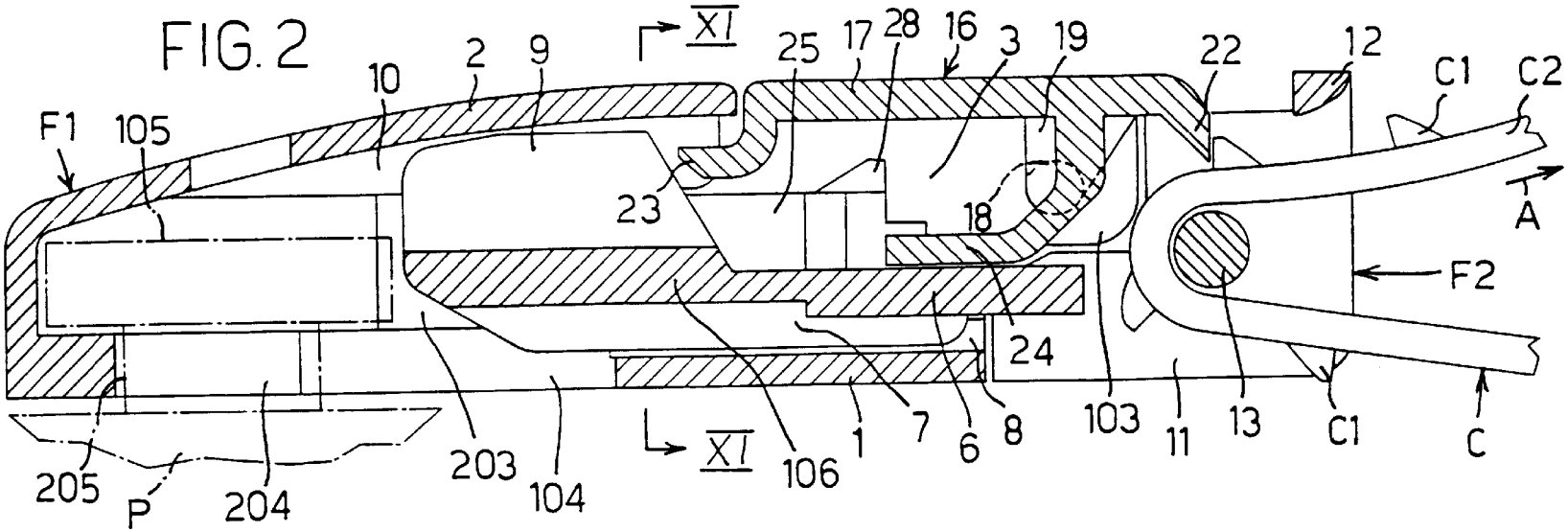
FIGS. 2 and 3 are enlarged longitudinal sectional views of the buckle, perpendicular to the plane of the heel strap of the fin, with the slidable strap-fastening part of the buckle being in its retracted strap-tightening position (FIG. 2) and in its forward strap-sliding position (FIG. 3).
Figure 3:
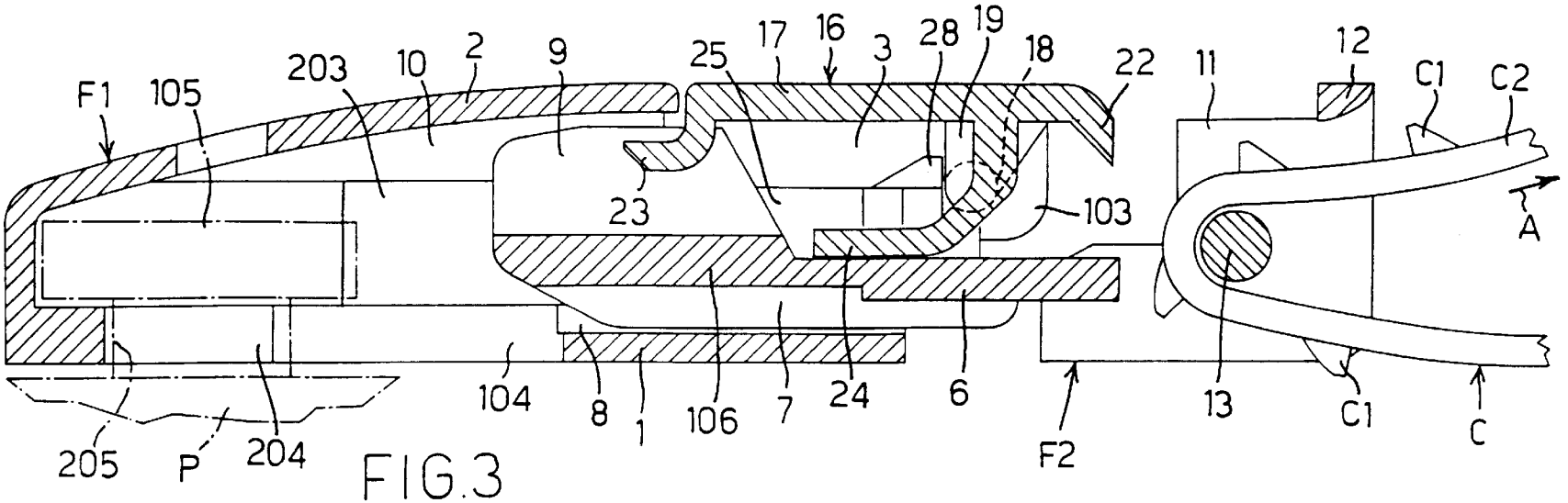

The heel strap C is provided, on its inner side, facing the foot of the user of the fin P, with sequential and spaced transverse teeth C1, and is returned around the strap-guiding roller 13 of the slidable strap-fastening part F2 of the buckle, in such a way that the smooth, non toothed side of the strap C is in contact with said strap-guiding roller 13. In order to tighten the strap C around the heel of the user of the fin P, the free end C2 of the strap, i.e. the end pushed around the strap-guiding roller 13, must be pulled in the direction of arrow A, as shown in FIGS. 1, 2 and 3. The teeth C1 of the strap C are preferably profiled in such a way that their forward side, facing the direction A, followed by the strap when it is tightened, is inclined, whereas their opposite side is straight, i.e. oriented substantially perpendicular to the strap.

The side walls 3 of the base part F1 of the buckle have, at their ends facing the strap-fastening part F2, projecting extensions 103, between which a strap-locking lever 16 is mounted, consisting of a substantially circular plate-like key 17, which is housed in a recess 102 having a complementary shape, formed in the corresponding end edge of the cover 2 of the base part F1 of the buckle. The strap-locking lever 16 can swing about an axis transverse to the longitudinal direction of the strap C and, to this end, it has two lateral wings 19, extending from the inner face of the plate-like key 17, perpendicular to the plane thereof, and bearing outward projecting coaxial journals 18, which are supported so as to rotate in corresponding holes 20, provided in the projecting extensions 103 of the side walls 3 of the base part F1 of the buckle. The journals 18 of the strap-locking lever 16 are inserted in their respective holes 20 of the extensions 103 of the side walls 3 by elastically opening said wall extensions 103 apart, with the help of guide grooves 21, formed in the inner faces of the wall extensions 103 and extending from the free edge (the upper edge in FIGS. 2, 3 and 4) thereof up to heir respective holes 20.

At the edge facing the slidable strap-fastening part F2 of the buckle, the strap-locking lever 16 has a strap-locking tooth 22, which projects out of the inner side of the plate-like key 17, and is meant to interact with the strap-guiding roller 13, by engaging the teeth C1 of the strap C, as described hereafter. At the opposite edge of the strap-locking lever 16, on the inner side of the plate-like key 17, there is provided a projecting abutment hook 23, which is meant to engage from the inside with the corresponding end edge of the cover 2 of the base part F1 of the buckle, so as to prevent an excessive outward movement of the corresponding end of the lever 16. In the middle position, from the inner side of the plate-like key 17 of the strap-locking lever 16, an elastic, substantially L-shaped tongue 24 extends, whose free end is slidably borne by the plate-like member 6 of the strap-fastening part F2 of the buckle. The strap-locking lever 16 described above is preferably made from a single plastic piece.

Figure 8:
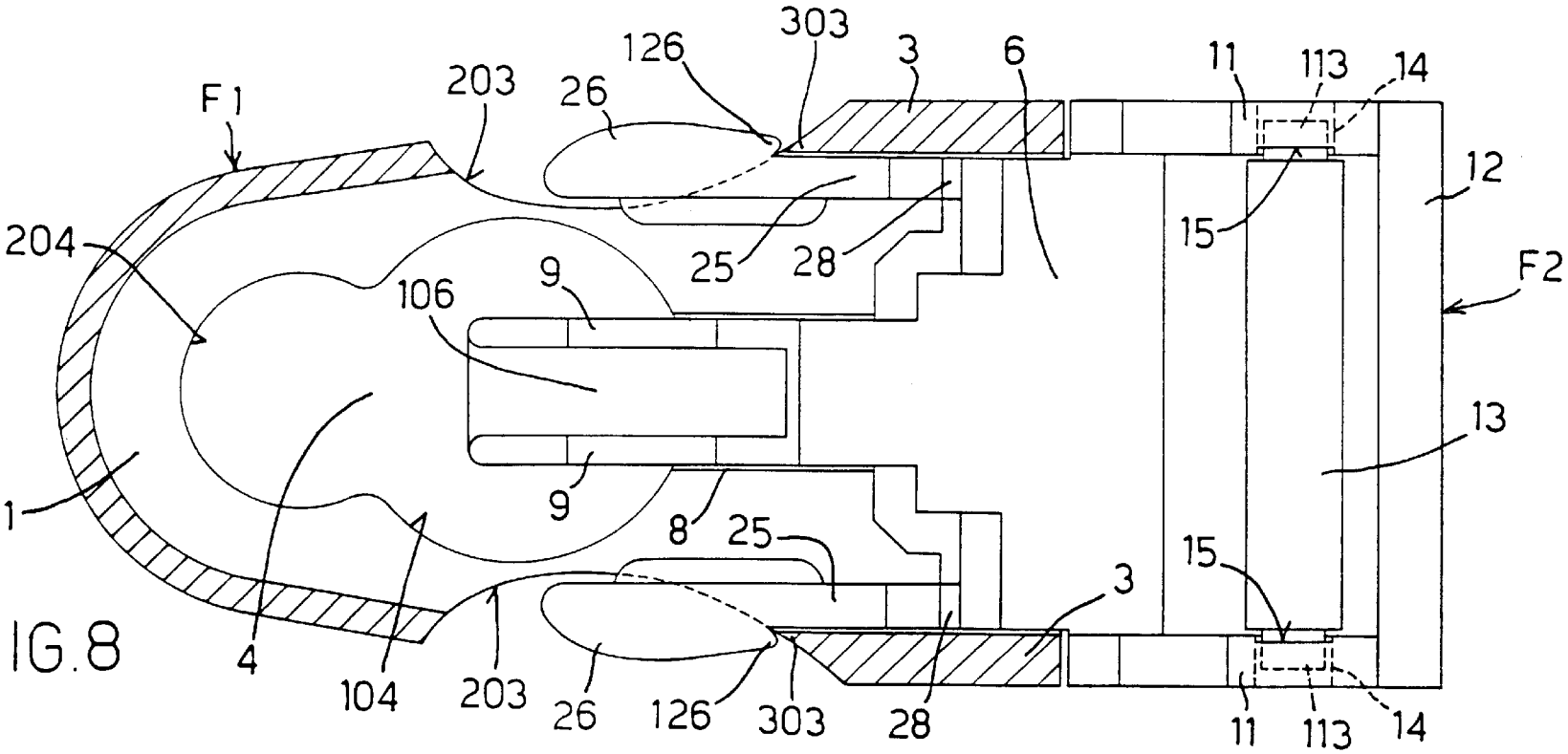
FIG. 8 is an enlarged longitudinal sectional view if the buckle, parallel to the plane of the heel strap.
Figure 9:
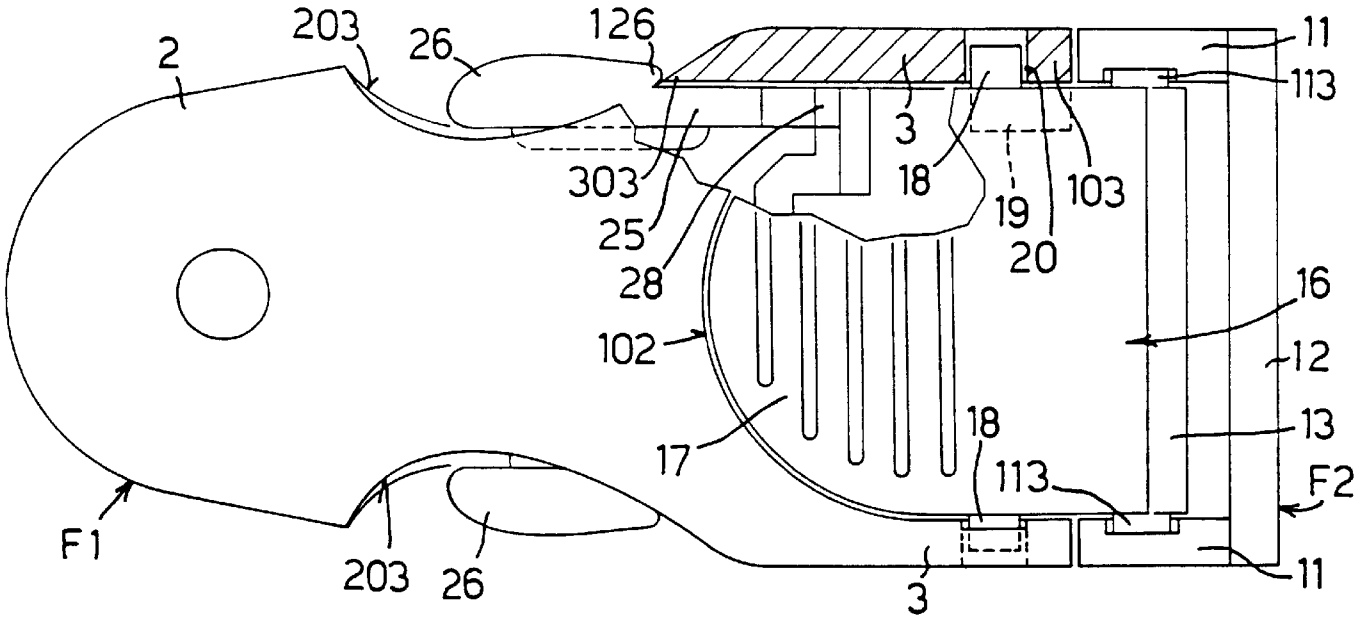
FIGS. 9 and 10 are enlarged top views, with a part seen in section, of the buckle, in the retracted strap-tightening position of the slidable strap-fastening part (FIG. 9) and in the forward strap-sliding position of said strap-fastening part (FIG. 10).
Figure 10:
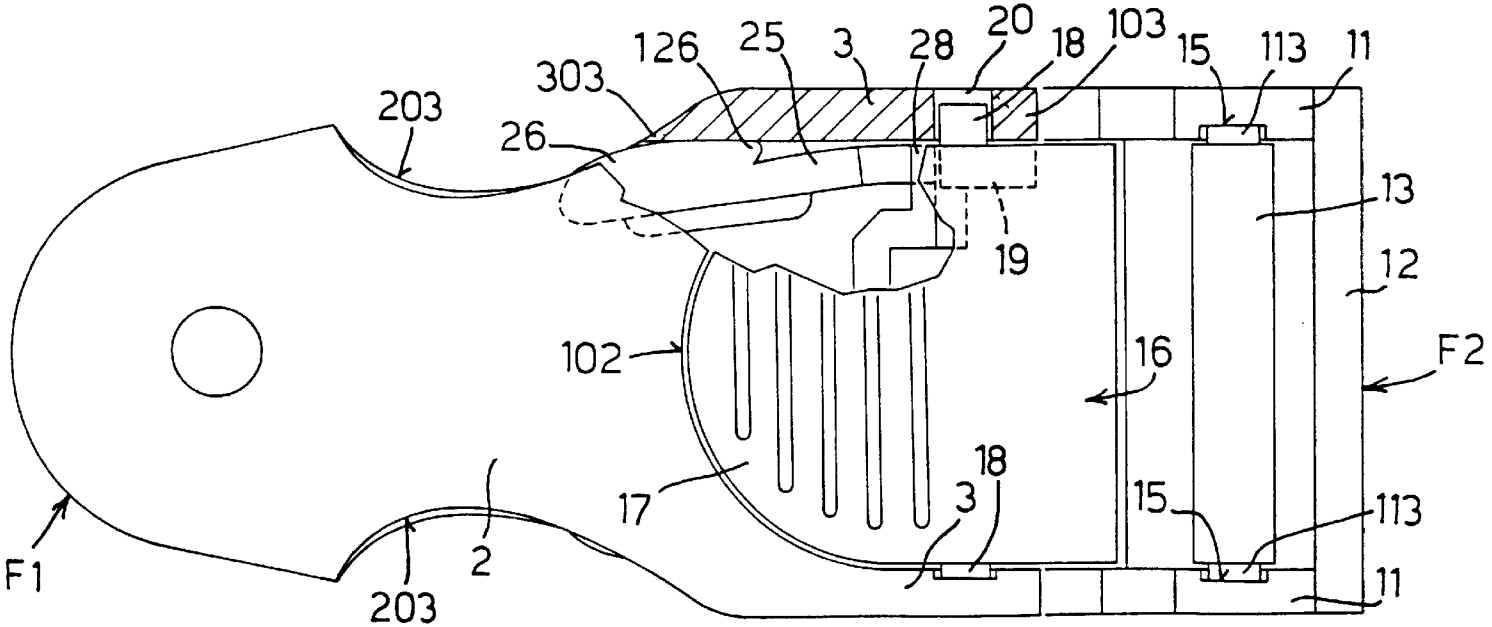
Figure 11:
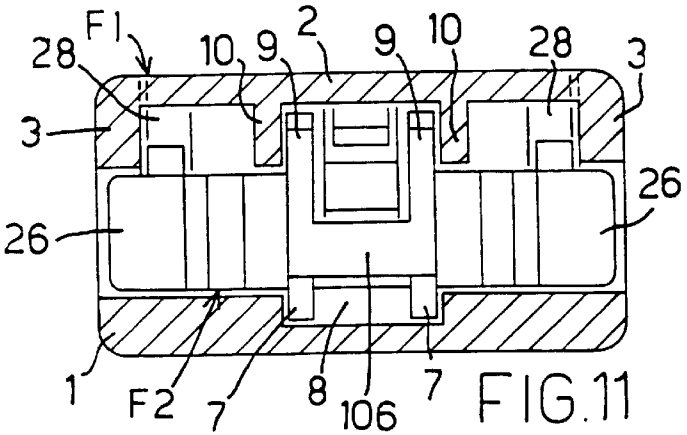
FIG. 11 is a cross section of the buckle, as seen across the line XI—XI of FIG. 2.

With respect to the base part F1, the slidable strap-fastening part F2 of the buckle may take a retracted strap-tightening position, shown in FIGS. 2, 8 and 9, and a forward strap-sliding position, shown in FIGS. 3 and 10, as desired.

In the retracted strap-tightening position, the slidable strap-fastening part F2 of the buckle is manually releasably hooked to the base part F1 of the buckle. To this purpose, in the illustrated embodiment, two lateral elastic hook up arms 25, parallel to each other and to the guide wings 9 of the strap-fastening part F2, and transversely spaced from said guide wings, extend projectingly from the plate-like member 6 of the strap-fastening part F2 towards the inside of the base part F1. At their free ends, the two hook up arms 25 terminate each with a button 26, which has a rounded outer surface and is meant to project laterally out of the base part F1 of the buckle through a corresponding aperture 203 formed in the side wall 3 of the box-like base part F1. The part of each bottom 26, facing the strap-fastening part F2 of the buckle has a hook-like shape 126, interacting with its respective edge 303, preferably chamfered, of the corresponding aperture 203 in the side wall 3 of the base part F1 of the buckle. In the retracted strap-tightening position of the slidable strap-fastening part F2 of the buckle, the buttons 26 formed at the ends of the two hook up arms 25 project laterally outwards through their respective apertures 203 and get hooked, by their hook-like parts 126 to their respective edges 303 of said apertures 203, thereby strongly linking the slidable strap-fastening part F2 of the buckle to the base part F1, as shown in FIGS. 8 and 9. In order to move the slidable strap-fastening part F2 to its forward strap-sliding position, the two hook-like 126 buttons 26 are simultaneously pushed inwardly, for example by two fingers of a hand, elastically bending their respective hook up arms 25 and thus releasing said hook-like 126 buttons 26 from their respective edges 303 of the apertures 23. Then, while the slidable strap-fastening part F2 is moved outwardly, the buttons 26 of the hook up arms 25 slide by their rounded outer surfaces, on the inner surfaces of the side walls 3 of the base part F1, as shown in FIG. 10. Once the opposite movement of the slidable strap-fastening part F2 is accomplished, which movement brings this part F2 of the buckle into its retracted strap-tightening position, the hook-like 126 buttons 26 automatically snap outwards through their respective lateral apertures 23 thanks to the elastic preload of the hook up arms 25, and thereby hook again the slidable strap-fastening part F2 to the base part F1 of the buckle.

In the forward strap-sliding position, the slidable strap-fastening part F2 of the buckle is stopped by abutment teeth 28, which are formed on the plate-like member 6 of said strap-fastening part F2 in coincidence with the two elastic hook up arms 25 and interact with their respective lateral inner wings 19 of the strap-locking lever, said wings 19 bearing the journals 18 around which this lever swings, as particularly shown in FIGS. 2, 3, 9 and 10. These abutment teeth 28 hit said wings 19, thereby preventing the slidable strap-fastening part F2 of the buckle from being completely extracted and detached from the base part F1 of the buckle, and ensuring, in this way, the continuous mutual connection between these two parts F1, F2 of the buckle. While the buckle is assembled, at first the slidable strap-fastening part F2 is inserted in the base part F1, and then the strap-locking lever 16 is mounted, therewith the wings 19 of this lever 16 are inserted in the path of the abutment teeth 28, to restrict the outward movement of these teeth.

Figure 4:
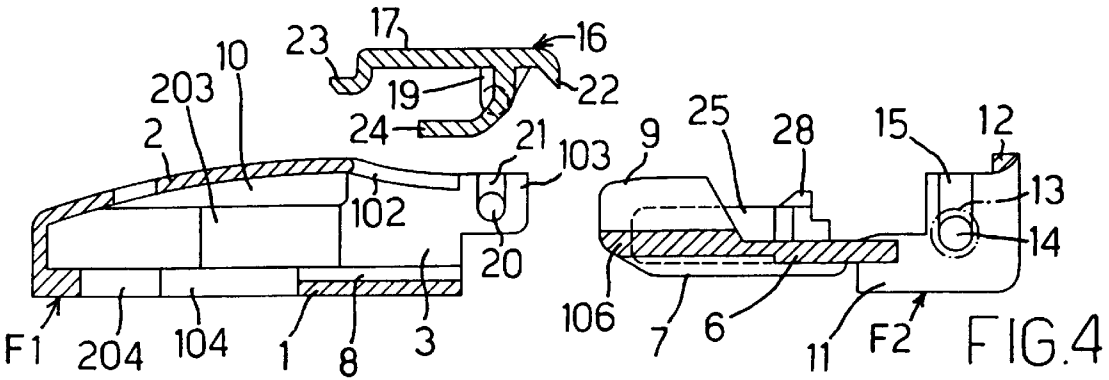
FIG. 4 is an exploded longitudinal sectional view of the buckle, perpendicular to the plane of the heel strap.
Figure 5:
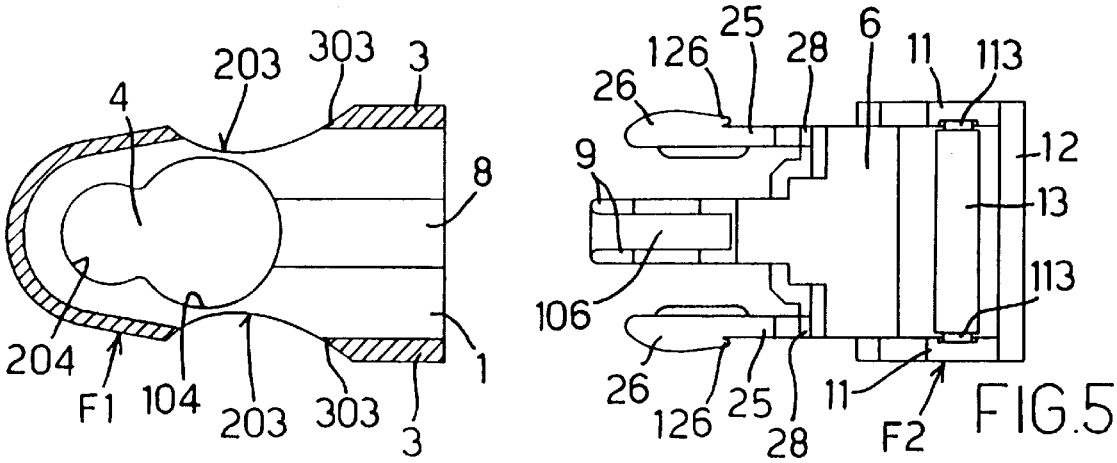
FIG. 5 shows the base part of the buckle (as seen in longitudinal section, parallel to the plane of the heel strap) and the corresponding slidable strap-fastening part of the buckle (as seen from the top), prior to assembly thereof.
Figure 6:
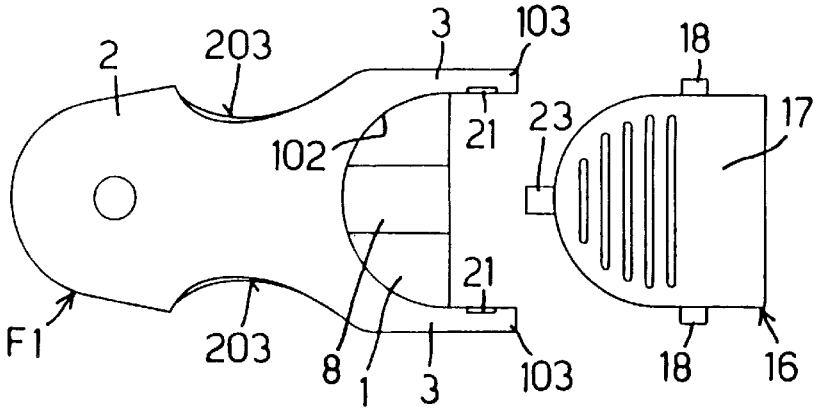
FIGS. 6 and 7 are top (FIG. 6) and bottom (FIG. 7) views of the base part of the buckle and of its respective strap-locking lever, prior to assembly thereof.
Figure 7:
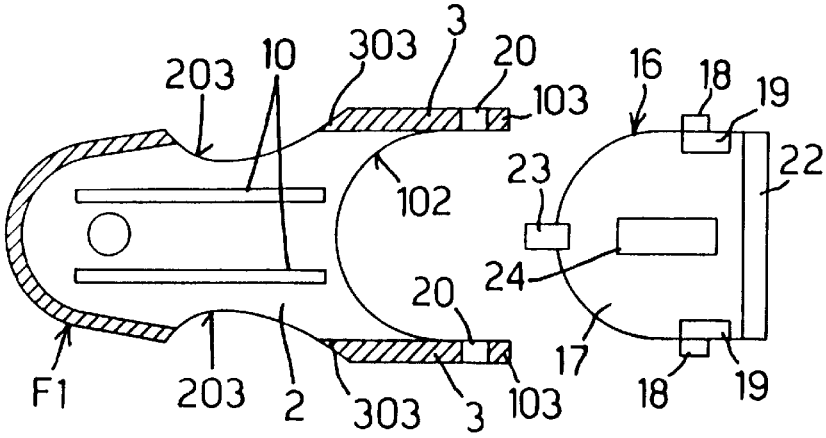

It should be noted that the opposite edges of the side walls 3, 103 and 11 of the base part F1 and of the slidable strap-fastening part F2 of the buckle are mutually complementarily shaped, as is shown in FIGS. 2, 3 and 4, so that, in the retracted strap-tightening position of the slidable strap-fastening part F2, the buckle F is closed, at its sides, by substantially continuous walls.

In the retracted strap-tightening position of the slidable strap-fastening part F2 of the buckle, the tooth 22 of the strap-locking lever 16 comes so close to the strap-guiding roller 13, that it engages with the teeth C1 of the strap C and, by interacting with said roller and abutting against the straight sides of the teeth C1 of the strap C, it prevents the heel strap C from sliding towards loosening, i.e. in the direction opposite to that of the arrow A, as shown in FIG. 2. However, at the same time, the tooth 22 of the strap-locking lever 16, by elastically jumping on the teeth C1 of the strap, i.e. by being elastically lifted by the inclined sides of said teeth C1 against the action of the counteracting spring formed by the elastic tongue 24 of the strap-locking lever 16, allows the heel strap C to be tightened by a manual pulling force exerted in the direction of arrow A, on the free end C2 of the strap, returned around the strap-guiding roller 13. In order to get the heel strap C to be loosened, in this retracted strap-tightening position of the slidable strap-fastening part F2 of the buckle, for example to adjust the tension thereof, the tooth 22 of the strap-locking lever 16 is lifted from the strap-guiding roller 13 and disengaged from the teeth C1 of the strap, making the lever 16 swing in this direction by exerting pressure from the outside on the part of the strap-releasing key 17 opposite to the tooth 22, against the counteracting force of the elastic tongue 24, acting as a spring.

In order to allow the heel strap C to be quickly and considerably loosened and, generally, to slide freely in both directions, without operating manually the strap-locking lever 16 through its strap-releasing key 17, the slidable strap-fastening part F2 of the buckle is released as described above from the base part F1 of the buckle and is brought to its forward strap-sliding position, in which, as is apparent from FIG. 3, the strap-guiding roller 13 is kept apart from the tooth 22 of the strap-locking lever 16 to such an extent that said tooth 22 is no longer engaged with the teeth C1 of the strap C. Therewith, the strap heel C may be made to slide freely and rapidly in both directions, i.e. both in the direction opposite to that of A, in order to get said strap to be quickly and relatively considerably loosened, for example to allow the fin P to be conveniently slipped off the foot of its user (possibly, and as required, even up to the complete extraction of the strap C from the strap-fastening part F2 of the buckle, i.e. up to the detachment thereof from the buckle F), and in the direction indicated by arrow A, for example to temporarily and approximately tighten the strap around the heel on application of the fin P to the foot. In both cases, after performing the quick and wide loosening or tightening movement of the heel strap C, the slidable strap-fastening part F2 of the buckle may be pushed again into its retracted strap-tightening position, in which the strap C is again locked on the strap-guiding roller 13 by the tooth 22 of the strap-locking lever 16, thereby being closed on the fin P and always connected to the buckle F, with its respected end.

The invention is not intended to be limited to the embodiment described and illustrated herein, but may be greatly modified and varied, especially as regards construction, and within the range of mechanical and functional equivalents, without departure from the guiding principle disclosed above and claimed below.

What is claimed is:

1. A buckle for a fastening strap of an object comprising a sequence of transverse teeth (C1), on one of its sides and is adjustably connected, at least at one of its ends, to the object to be fastened, at one side of the object, by means of the buckle (F), which comprises a strap-guiding member (13), extending on a non-toothed side of the strap (C), transverse thereto, and around which said one of its ends is returned, and a movable strap-locking tooth (22), extending, transverse to the strap (C), on the toothed side thereof, in coincidence with the strap-guiding member (13), and cooperating, together with a counteracting elastic means (24), with the teeth (C1) of the strap (C), in such a way that the strap is only allowed to slide freely, subject to a manual pulling force exerted on a free returned end (C2) of the strap, towards (A) tightening the strap, whereas the strap is prevented from sliding in an opposite direction towards loosening the strap, a hand-operated strap-releasing means (17), for moving the strap-locking tooth (22) away from the strap-guiding member (13), against the action of the associated counteracting elastic means (24), to such an extent as to disengage the strap-locking tooth (22) from the strap teeth (C1) and to allow the strap to slide freely in both senses only as long as the manual action is exerted on the strap-releasing means (17), characterized in that the buckle (F) consists of a base part (F1), attached to the object to be fastened, to one side of the object and comprising the movable strap-locking tooth (22), its respective counteracting elastic means (24) and manual strap-releasing means (17), and of a strap-fastening part (F2), which only comprises strap-guiding means (13) for returning the strap (C), and is joined to the base part (F1), in such a way as to be able to slide in the longitudinal direction of the strap (C) and between a retracted strap-tightening position, wherein it is hooked to the base part (F1) of the buckle, in a manually releasable way, and the strap-guiding member (13) is close to the strap-locking tooth (22), such that said tooth (22) is operatively engaged with the teeth (C1) of the strap (C) and only allows the strap to slide freely towards (A) tightening it, and a forward strap-sliding position, wherein the strap-guiding member (13) is moved away from the strap-locking tooth (22), to such an extent, that said tooth (22) is disengaged from the teeth (C1) of the strap (C) and allows the strap to slide freely in both senses.

2. A buckle as claimed in claim 1, characterized in that between the base part (F1) and the slidable strap-fastening part (F2) of the buckle (F), there are provided cooperating end-of-stroke abutments (28, 19), which are engaged with each other in the forward strap-sliding position of the strap-fastening part (F2), and prevent said strap-fastening part (F2) from being further extracted and detached from the base part (F1) of the buckle (F).

3. A buckle as claimed in claim 1, characterized in that the slidable strap-fastening part (F2) is guided by the base part (F1) through a system of guide ribs (7, 9, 10) and grooves (8), interacting with and parallel to each other, and extending in the longitudinal direction of the strap (C).

4. A buckle as claimed in claim 1, characterized in that the strap-locking tooth (22) is provided on a strap-locking lever (16), which is mounted in such a way as to swing about an axis transverse to the strap (C) having to lateral coaxial journals (18), supported in corresponding holes (14), formed in opposite side walls (3, 103) of the base part (F1) of the buckle.

5. A buckle as claimed in claim 4, characterized in that the end-of-stroke abutments (28), provided on the base part (F1) of the buckle interact with associated abutment parts (19) of the strap-locking lever (16).

6. A buckle as claimed in claim 4, characterized in that the strap-locking lever (16) is made of one piece with a strap-releasing key (17), extending, from the fulcrum around which the lever swings (18—18), on a side opposite to the strap-locking tooth (22).

7. A buckle as claimed in claim 6, characterized in that the strap-releasing key (17) of the strap-locking lever (16) is substantially coplanar to a cover (2) of the base part (F1) and is an integral part thereof, being housed in a notch (102) having a complementary shape, which is formed in said cover (2).

8. A buckle as claimed in claim 7, characterized in that the strap-releasing key (17) of the strap-locking lever (16) is integral with a hook-like part (23), cooperating, as an inner stroke-limiting abutment, with the edge of the notch (102), formed in the cover (2) of the base part (F1) of the buckle.

9. A buckle as claimed in claim 4, characterized in that the counteracting elastic means, associated to the strap-locking tooth (22), consist in an elastic tongue (24), made of one piece with the strap-locking lever (16).

10. A buckle as claimed in claim 4, characterized in that the strap-locking lever (16) has two lateral wings (19), integral with the journals (18) which project outwardly from said wings and are engaged in holes (20) formed in elastically openable projecting extensions (103) of the side walls (3) of the base part (F1) of the buckle, whereas the end-of-stroke abutments (28), provided on the slidable strap-fastening part (F2) of the buckle interact with said journal-bearing wings (19) of the strap-locking lever (16).

11. A buckle as claimed in claim 4, characterized in that the slidable strap-fastening part (F2) of the buckle is integral with two lateral elastic hook up arms (25), extending inside the base part (F1), and whose ends, having the form of buttons (26) and provided with hooks (126), project outwardly or are accessible from the outside, through corresponding apertures (203) formed in the side walls (3) of the box-like base part (F1) of the buckle and are automatically hooked to the edges (303) of these apertures (203) in the retracted strap-stretching position of the slidable strap-fastening part (F2) of the buckle, whereas they may be released from said edges (303) by inward elastic deflection of the hook up arms (25), when a corresponding manual pressure is exerted on the button (26) of these arms.

12. A buckle as claimed in claim 1, characterized in that the base part (F1) of the buckle has a box-like shape, and is provided with a bottom (1), a cover (2), and side walls (3, 103), while it is open towards the strap-fastening part (F2).

13. A buckle as claimed in claim 1, characterized in that a system of guide ribs and grooves between the base part (F1) and the slidable strap-fastening part (F2) is provided on the inner side both on the bottom (1) and on the cover (2) of the base part (F1).

14. A buckle as claimed in claim 1, characterized in that between the base part (F1) and the slidable strap-fastening part (F2) of the buckle, there are provided hook up means (25, 26, 126, 303) of the elastic snap coupling type, which may be manually uncoupled.

15. A buckle as claimed in claim 1, characterized in that the strap-guiding member, mounted on the slidable strap-fastening part (F2) of the buckle consists of a roller (13), having end journals (113), rotatably supported in corresponding holes (14), formed in elastically openable side walls (11) of the strap-fastening part (F2) of the buckle.

16. A buckle as claimed in claim 1, characterized in that the opposite edges of opposite side walls (3, 103 and 11) of the base part (F1) and of the slidable strap-fastening part (F2) have complementary shapes.

17. A buckle as claimed in claim 1, characterized in that, in a bottom (1) of the base part (F1), there is provided an opening (4), which is composed of two parts (104, 204), having different diameters, in order to link this base part (F1) to the object to be fastened, particularly to the body of a fin (P).

18. The buckle as claimed in claim 1, wherein the object is a swim fin and wherein the buckle is connected to a heel strap of the swim fin along a footpocket.

* * * * *